US010316432B2

(12) United States Patent
Tayi et al.

(10) Patent No.: US 10,316,432 B2
(45) Date of Patent: Jun. 11, 2019

(54) ELECTROSPINNING OF PEPTIDE AMPHIPHILES

(71) Applicant: Northwestern University, Evanston, IL (US)

(72) Inventors: Alok S. Tayi, Niskayuna, NY (US); E. Thomas Pashuck, III, London (GB); Samuel I. Stupp, Chicago, IL (US)

(73) Assignee: Northwestern University, Evanston, IL (US)

( * ) Notice: Subject to any disclaimer, the term of this patent is extended or adjusted under 35 U.S.C. 154(b) by 1075 days.

(21) Appl. No.: 14/502,180

(22) Filed: Sep. 30, 2014

(65) Prior Publication Data

US 2015/0093574 A1 Apr. 2, 2015

Related U.S. Application Data

(60) Provisional application No. 61/884,585, filed on Sep. 30, 2013.

(51) Int. Cl.
*D01F 6/68* (2006.01)
*D01D 5/00* (2006.01)

(52) U.S. Cl.
CPC ..... *D01F 6/68* (2013.01); *D01D 5/0053* (2013.01); *Y10T 428/298* (2015.01)

(58) Field of Classification Search
CPC ..... D01D 5/007; D01D 5/0053; D01F 6/68; D01B 2331/08
See application file for complete search history.

(56) References Cited

U.S. PATENT DOCUMENTS

2008/0299657 A1 12/2008 Stupp
2009/0061190 A1* 3/2009 Gazit ..... C07K 5/06078 428/220

FOREIGN PATENT DOCUMENTS

WO 2013134360 9/2013
WO 2015048746 4/2015

OTHER PUBLICATIONS

Boekhoven et al., 25th anniversary article: supramolecular materials for regenerative medicine, Adv Mater, 2014, 26:1642-1659.
Cashion et al., Gemini surfactant electrospun membranes, Langmuir, 2010, 26:678-683.
Celebioglu et al., Electrospinning of polymer-free nanofibers from cyclodextrin inclusion complexes, Langmuir, 2011, 27:6218-6226.
Cui et al., Self-assembly of giant peptide nanobelts, Nano Lett., 2009, 9:945-951.
Deitzel et al., Controlled deposition of electrospun poly (ethylene oxide) fibers, Polymer, 2001, 42:8163-8170.
Fong et al., Beaded nanofibers formed during electrospinning, Polymer, 1999, 40:4585-4592.

(Continued)

*Primary Examiner* — Holly C Rickman
(74) *Attorney, Agent, or Firm* — Casimir Jones SC; David W. Staple

(57) ABSTRACT

Provided herein are methods for the manufacture of fibers from solution-phase peptide-based polymers by electrospinning, and compositions produced thereby. In particular embodiments, various embodiments provide electrospinning supramolecular fibers from low concentration peptide amphiphile filaments.

6 Claims, 6 Drawing Sheets

Specification includes a Sequence Listing.

(56) References Cited

OTHER PUBLICATIONS

Grodowska et al., Organic solvents in the pharmaceutical industry, Acta Pol, Pharm, 2010, 67:3-12.
Han et al., Viscoelastic electrospun jets: Initial stresses and elongational, Polymer, 2008, 49:1651-1658.
Hartgerink et al., Peptide-amphiphile nanofibers: a versatile scaffold for the preparation of self-assembling materials, PNAS, 2002, 99:5133-5138.
Hartgerink et al., Self-assembly and mineralization of peptide-amphiphile nanofibers, Science, 2001, 294:1684-1688.
Huang et al, Biological synthesis of tooth enamel instructed by an artificial matrix, Biomaterials, 2010, 31:9202-9211.
Israelachvili Intermolecular and surface forces; 2nd ed.; Academic: London San Diego, 1992.
Li et al., Electrospinning of Nanofibers: Reinventing the Wheel?, Adv Mater, 2004, 16:1151-1170.
Li et al., Electrospun silk-BMP-2 scaffolds for bone tissue engineering, Biomaterials, 2006, 27:3115-3124.
Li et al., Electrospinning of Polymeric and Ceramic Nanofibers as Uniaxially Aligned Arrays, Nano Lett, 2003, 3:1167-1171.
Li et al., Multilineage differentiation of human mesenchymal stem cells in a three-dimensional nanofibrous scaffold, Biomaterials, 2005, 26:5158-5166.
Li et al., A three-dimensional nanofibrous scaffold for cartilage tissue engineering using human mesenchymal stem cells, Biomaterials, 2005, 26:599-609.
Mata et al., Bone regeneration mediated by biomimetic mineralization of a nanofiber matrix, Biomaterials, 2010, 31:6004-6012.
Matthews et al., Electrospinning of collagen nanofibers, Biomacromolecules, 2002, 3:232-238.
Mayo et al., A recipe for designing water-soluble, beta-sheet-forming peptides, Protein Sci, 1996, 5:1301-1315.
McKee et al., Phospholipid nonwoven electrospun membranes, Science, 2006, 311:353-355.
Pashuck et al., Tuning supramolecular rigidity of peptide fibers through molecular structure, J Am Chem Soc, 2010, 132:6041-6046.
Pashuck et al., Direct observation of morphological tranformation from twisted ribbons into helical ribbon, J. Am. Chem. Soc., 2010, 132:8819-8821.
Reneker et al., Nanometre diameter fibres of polymer, produced by electrospinning, Nanotechnology, 1996, 7:216-223.
Reneker et al., Electrospinning jets and polymer nanofibers, Polymer, 2008, 49:2387-2425.
Shah et al, Supramolecular design of self-assembling nanofibers for cartilage regeneration, PNAS, 2010, 107:3293-3298.
Singh et al., Electrospinning of Diphenylalanine Nanotubes, Adv Materials, 2008, 20:2332-2336.
Tayi et al., Electrospinning Bioactive Supramolecular Polymers from Water, Biomacromolecules,2014, 5:1323-1327.
Tysseling et al., Self-assembling peptide amphiphile promotes plasticity of serotonergic fibers following spinal cord injury, J. Neurosci. Res. 2010, 88 , 3161-3170.
Webber et al., Supramolecular nanostructures that mimic VEGF as a strategy for ischemic tissue repair, PNAS, 2011, 108:13438-13443.
Yan et al., Supramolecular polymer nanofibers via electrospinning of a heteroditopic monomer, Chem. Commun. 2011, 47:7086-7088.
Zhang et al., A self-assembly pathway to aligned monodomain gels, Nat Mater, 2010, 9:594-601.
International Search Report and Written Opinion for PCT/US2014/058315, dated Jan. 7, 2015, 14 pages.

* cited by examiner

ELECTROSPINNING OF PEPTIDE AMPHIPHILES

CROSS REFERENCE TO RELATED APPLICATIONS

The present application claims the benefit of U.S. Provisional Patent Application Ser. No. 61/884,585, filed Sep. 30, 2013, which is incorporated by reference in its entirety.

FIELD

Provided herein are methods for the manufacture of supramolecular fibers from solution-phase peptide-based assemblies by electrospinning, and compositions produced thereby. In particular embodiments, methods of electrospinning supramolecular fibers from low concentration peptide amphiphile filaments are provided.

BACKGROUND

Electrospinning is an efficient process that produces nanometer-to-micrometer sized fibers with tunable diameter (Li et al. *Nano Letters* 3, 1167 (2003); Darrell & Iksoo *Nanotechnology* 7, 216 (1996); Fong et al. *Polymer* 40, 4585 (July, 1999); incorporated by reference in their entireties). Nanofiber films produced by electrospinning provide a promising platform for biomaterials. Electrospinning has been traditionally used to form fibers from high molecular weight polymers, but has recently been extended to supramolecular assemblies, such as surfactants (Cashion et al. *Langmuir* 26, 678 (2010); McKee et al. *Science* 311, 353 (2006); herein incorporated by reference in their entireties), peptides (Singh et al. *Adv Mater* 20, 2332 (2008); herein incorporated by reference in its entirety), host-guest molecules (Yan et al. *Chem Commun* 47, 7086 (2011); herein incorporated by reference in its entirety), and cyclodextrin (Celebioglu & Uyar. *Langmuir* 27, 6218 (2011); herein incorporated by reference in its entirety). However, electrospinning small molecules requires high concentrations and organic solvents. Organic solvents can be undesirable in biomedical material processing because residual solvent needs to be removed; additionally, non-aqueous conditions can cause denaturation of bioactive proteins, preventing bioactivity.

Peptide amphiphiles (Hartgerink et al. *P Natl Acad Sci USA* 99, 5133 (2002); Hartgerink et al. *Science* 294, 1684 (2001); herein incorporated by reference in their entireties) (PAs) are a class of self-assembling molecules that are composed of a hydrophobic segment conjugated to a sequence of amino acids. PAs can form long, high aspect ratio filaments in water and have been studied for a range of applications in regenerative medicine (Mata et al., *Biomaterials* 31, 6004 (2010); Shah et al., P Natl Acad Sci USA 107, 3293 (2010); Huang et al. Biomaterials 31, 9202 (2010); Webber et al., P Natl Acad Sci USA 108, 13438 (2011); herein incorporated by reference in their entireties). PA bioactivity is derived from presentation of biological epitopes on the surface of self-assembled nanostructures that form in solution. The rheological properties of these materials can be tuned by concentration and peptide sequence (Pashuck et al. *Journal of the American Chemical Society* 132, 6041 (2010); herein incorporated by reference in its entirety).

SUMMARY

Provided herein are methods for the manufacture of fibers from solution-phase peptide-based supramolecular polymers by electrospinning, and compositions produced thereby. In particular embodiments, provided herein are electrospinning fibers from low concentrations of peptide amphiphiles. In some embodiments, provided herein are method including solution-phase assembly, electrospinning of peptide amphiphile (PA) supramolecular fibers from solution-phase filaments (e.g., peptide amphiphiles), and characterization of the compositions and materials produced therefrom.

In some embodiments, provided herein are compositions comprising a fiber of peptide amphiphiles. In some embodiments, the peptide amphiphiles comprises a hydrophobic segment and a peptide segment. In some embodiments, the hydrophobic segment comprises an alkyl chain. In some embodiments, the alkyl chain is a $C_{10}$-$C_{30}$ alkane. In some embodiments, the peptide segment comprises amino acids selected from valine (V), glutamic acid (E), and alanine (A). In some embodiments, the peptide segment consists of, or consists essentially of amino acids selected from V, E, and A. In some embodiments, the peptide segment comprises a sequence selected from $E_2V_3$ and $V_3A_3E_3$. In some embodiments, the electrospun fiber comprises a homogeneous population of peptide amphiphiles. In some embodiments, the electrospun fiber comprises a plurality of self-assembled nanofilaments. In some embodiments, the nanofilaments maintain their self-assembled structure within the electrospun fiber. In some embodiments, the nanofilament has a width of 5-50 nm (e.g., 5 nm, 10 nm, 15 nm, 20 nm, 25 nm, 30 nm, 35 nm, 40 nm, 45 nm, 50 nm, and ranges therein). In some embodiments, the nanofilament is a twisted ribbon. In some embodiments, the nanofilament is cylindrical. In some embodiments, the nanofilament is a twisted ribbon and has a periodicity of 100-400 nm. In some embodiments, the nanofilaments are axially aligned along the long axis of the supramolecular fiber. In some embodiments, the electrospun fiber has a diameter of 10 nm-10 μm (e.g., 10 nm . . . 20 nm . . . 50 nm . . . 100 nm . . . 200 nm . . . 500 nm . . . 1 μm . . . 2 μm . . . 5 μm . . . 10 μm, and diameters and ranges therein). In some embodiments, the electrospun fiber has a diameter of 2-7 μm, 3-5 μm etc. In some embodiments, a composition comprises a plurality of the electrospun fibers.

In some embodiments, provided herein are methods of manufacturing electrospun fibers comprising self-assembled nanofilaments of peptide amphiphiles. In some embodiments, methods comprise the steps of: (a) dissolving peptide amphiphiles in solvent under conditions such that the peptide amphiphiles form nanofilaments; and (b) electrospinning the nanofilaments to produce electrospun fibers. In some embodiments, dissolving comprises a sonication step. In some embodiments, dissolving does not require heat treatment (e.g., above room temperature), surfactants, salts, etc. In some embodiments, peptide amphiphiles are dissolved at, or diluted to, a concentration 0.1 to 5 wt %. In some embodiments, electrospinning is performed at 5-20 kV (e.g., 5 kV . . . 10 kV . . . 15 kV . . . 20 kV). In some embodiments, electrospinning is performed with a needle-to-collector distance of 1-40 cm (e.g., 1 cm . . . 2 cm . . . 5 cm . . . 10 cm . . . 15 cm . . . 20 cm . . . 25 cm . . . 30 cm . . . 35 cm . . . 40 cm). In some embodiments, electrospinning is performed with a ratio of voltage to needle-to-collector distance of 0.5 to 4 kV/cm (e.g., 0.5 kV/cm . . . 1.0 kV/cm . . . 2.0 kV/cm . . . 3.0 kV/cm . . . 4.0 kV/cm). In some embodiments, electrospinning is performed at a flow rate of 0.01-0.2 mL/h (e.g., 0.01 mL/h . . . 0.02 mL/h . . . 0.05 mL/h . . . 0.1 mL/h . . . 0.15 mL/h . . . 0.2 mL/h). In some embodiments, the peptide amphiphile comprises a hydrophobic segment and a peptide segment. In some embodiments, the hydrophobic segment comprises an alkyl chain. In some embodiments, the alkyl chain is a $C_{10}$-$C_{30}$ alkane ($C_{10} \ldots C_{13} \ldots C_{16} \ldots C_{19} \ldots C_{22} \ldots C_{25} \ldots C_{28} \ldots C_{30}$). In some embodiments, the peptide segment comprises amino acids selected from valine (V), glutamic acid (E), and alanine (A). In some embodiments, the peptide segment consists of, or consists essentially of, amino acids selected from V, E, and A. In some embodiments, the peptide segment comprises a sequence selected from $E_2V_3$ and $V_3A_3E_3$. In some embodiments, the peptide amphiphiles comprise a homogeneous population of peptide amphiphiles. In some embodiments, the solvent comprises water.

In some embodiments, provided herein are fibers of a plurality of axially-aligned nanofilaments, wherein the nanofilaments comprise self-assembled peptide amphiphiles, wherein the self-assembling peptide amphiphile comprise a hydrophobic segment and a peptide segment, and wherein the peptide amphiphiles interact to form nanofilaments having a hydrophobic core and peptidic exterior. In some embodiments, said fibers a microscopic. In some embodiments, said fibers are between 0.1 and 10 μm in diameter (e.g., 0.1 μm, 0.2 μm, 0.3 μm, 0.4 μm 0.5 μm, 0.6 μm, 0.7 μm, 0.8 μm, 0.9 μm, 1 μm, 2 μm, 3 μm, 4 μm, 5 μm, 6 μm, 7 μm, 8 μm, 9 μm, 10 μm, and ranges therein). In some embodiments, the filiments have widths or diameters of 5-50 nm (e.g., 5 nm, 10 nm, 15 nm, 20 nm, 25 nm, 30 nm, 35 nm, 40 nm, 45 nm, 50 nm, and ranges therein). In some embodiments, the fibers are dehydrated, dry, and/or substantially devoid of water.

DEFINITIONS

Figure 1:
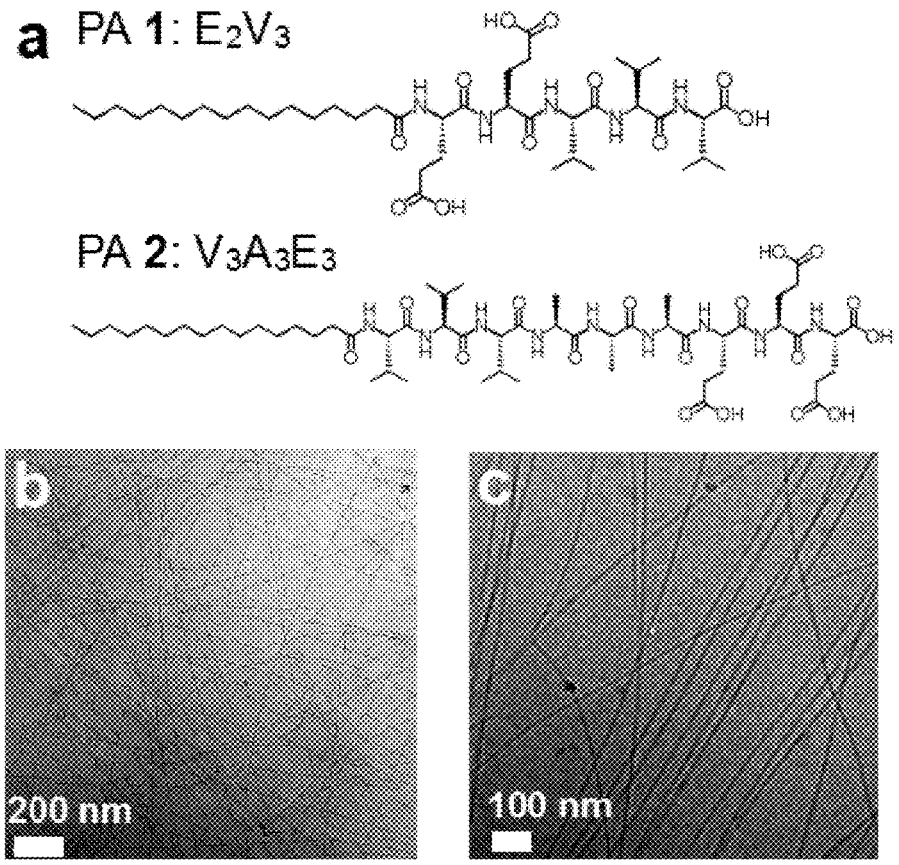
FIG. 1 shows (a) molecular structure of peptide amphiphiles 1 and 2, (b) cryo-TEM image of PA 1 illustrating twisted ribbon morphology of nanostructures, (c) cryo-TEM image of PA 2 illustrating fibrous morphology of nanostructures.

Although any methods and materials similar or equivalent to those described herein can be used in the practice or testing of embodiments described herein, some preferred methods, compositions, devices, and materials are described herein. However, before the present materials and methods are described, it is to be understood that this invention is not limited to the particular molecules, compositions, methodologies or protocols herein described, as these may vary in accordance with routine experimentation and optimization. It is also to be understood that the terminology used in the description is for the purpose of describing the particular versions or embodiments only, and is not intended to limit the scope of the herein.

Unless otherwise defined, all technical and scientific terms used herein have the same meaning as commonly understood by one of ordinary skill in the art to which this invention belongs. However, in case of conflict, the present specification, including definitions, will control. Accordingly, as the terms are used herein, the following definitions apply.

As used herein and in the appended claims, the singular forms "a", "an" and "the" include plural reference unless the context clearly dictates otherwise. Thus, for example, reference to "a peptide amphiphile" is a reference to one or more peptide amphiphiles and equivalents thereof known to those skilled in the art, and so forth.

As used herein, the term "peptide amphiphile" refers to a molecule that, at a minimum, includes a non-peptide lipophilic (hydrophobic) segment, a structural peptide segment and optionally a functional peptide segment (or epitope). The peptide amphiphile may express a net charge at physiological pH, either a net positive or negative net charge, or may be zwitterionic (i.e., carrying both positive and negative charges). Certain peptide amphiphiles consist or comprise four segments: (1) a hydrophobic, non-peptidic segment comprising an acyl group of six or more carbons, (2) a β-sheet-forming peptide segment; (3) a charged peptide segment, and (4) a targeting moiety (e.g., targeting peptide).

As used herein, the terms "self-assemble" and "self-assembly" refer to formation of a discrete, non-random, aggregate structure from component parts; said assembly occurring spontaneously through random movements of the components (e.g. molecules) due only to the inherent chemical or structural properties and attractive forces of those components.

As used herein, the term "supramolecular" (e.g., "supramolecular complex," "supramolecular interactions," "supramolecular fiber," "supramolecular polymer," etc.) refers to the non-covalent interactions between molecules (e.g., polymers, marcomolecules, etc.) and the multicomponent assemblies, complexes, systems, and/or fibers that form as a result.

As used herein, the term "physiological conditions" refers to the range of conditions of temperature, pH and tonicity (or osmolality) normally encountered within tissues in the body of a living human.

DETAILED DESCRIPTION

Provided herein are methods for the manufacture of electrospun fibers from solution-phase peptide-based nanofilaments by electrospinning, and compositions produced thereby. In particular embodiments, provided herein are supramolecular fibers electrospun from solutions with low concentrations of peptide amphiphile filaments.

Experiments were conducted during development of embodiments described herein in which electrospun fibers were produced from PA building blocks via electrospinning. In some embodiments, electrospun fibers are electrospun from self-assembled peptide amphiphile filaments. In particular embodiments, the electrospun fibers resemble a composite of individual self-assembled PA nanofilaments (e.g., the specific architecture of the nanofiber filament is maintained within the electrospun fiber).

In some embodiments, compositions of the described herein comprise PA building blocks. In certain embodiments, PAs for use in various embodiments comprise a hydrophobic segment and a peptide segment. In several embodiments, a hydrophobic (e.g., hydrocarbon and/or alkyl tail) segment of sufficient length (e.g., >3 carbons, >5 carbons, >7 carbons, >9 carbons, etc.) is covalently coupled to a peptide segment (e.g., an ionic peptide having a preference for beta-strand conformations) to yield a peptide amphiphile molecule. In some embodiments, a plurality of such PAs will assemble in water (or aqueous solution) into nanofilament (a.k.a. nanofiber) structures. In various embodiments, the broader peptide segment and narrower hydrophobic segment result in a generally conical molecular shape. In particular embodiments, the conical shape has an effect on the assembly of PAs (See, e.g., J. N. Israelachvili Intermolecular and surface forces; 2nd ed.; Academic: London San Diego, 1992; herein incorporated by reference in its entirety). In various embodiments, hydrophobic segments pack in the center of the assembly with the peptide segments exposed to an aqueous or hydrophilic environment to form cylindrical nanostructures that resemble filaments. Such nanofilaments display the peptide regions on their exterior and have a hydrophobic core.

In some embodiments, the hydrophobic segment is a non-peptide segment (e.g., alkyl group). In some embodiments, the hydrophobic segment comprises an alkyl chain (e.g., saturated) of 4-25 carbons (e.g., 4, 5, 6, 7, 8, 9, 10, 11, 12, 13, 14, 15, 16, 17, 18, 19, 20, 21, 22, 23, 24, 25), fluorinated segments, fluorinated alkyl tails, aromatic segments, pi-conjugated segments, etc.

In some embodiments, the peptide segment is an anionic peptide and/or beta-sheet forming peptide. Peptide segments capable of interacting to form beta sheets and/or with a propensity to form beta sheets are understood (See, e.g., Mayo et al. *Protein Science* (1996), 5:1301-1315; herein incorporated by reference in its entirety). Although, in some embodiments, crosslinking, polymerization or other covalent or non-covalent interactions are exploited to assist in assembly or stability of a complex, self-assembly of the PAs into nanofilaments is primarily driven by hydrophobic forces between the hydrophobic segments and beta-sheet formation among peptide segments. In some embodiments, the attractive and/or assembly forces between peptide segments are not limited to beta-sheet forming forces. Peptides that result in other filament forming forces are within the scope of embodiments herein.

In some embodiments, the peptide segment comprises an assembly portion (e.g., beta-sheet forming peptide) or a portion that drives the self-assembly of the peptide amphiphiles into nanofilaments. However, in certain embodiments, the peptide segment is not so limited. In some embodiments, in addition to the assembly portion a peptide segment comprises one or more of: a crosslink portion (e.g., peptide capable of crosslinking between PAs), epitope portion (e.g., antigen for an antibody), binding portion (e.g., binding partner for a protein, peptide, small molecule, etc.), ligand portion, or other functional peptide.

In some embodiments, suitable peptide amphiphiles comprise the peptides EEVV (SEQ ID NO.: 1) or VVVAAAEEE (SEQ ID NO.: 2) or other combinations of E, V, and A amino acids. In some embodiments, peptides comprise EEVV (SEQ ID NO.: 1) or VVVAAAEEE (SEQ ID NO.: 2) and additional peptide sequences. In some embodiments, the additional peptide sequences are attached to EEVV (SEQ ID NO.: 1) or VVVAAAEEE (SEQ ID NO.: 2). In some embodiments, a composition comprises peptide amphiphiles comprising EEVV (SEQ ID NO.: 1) or VVVAAAEEE (SEQ ID NO.: 2), as well as peptide amphiphiles comprising other peptide sequences. In some embodiments, additional peptide sequences (e.g., other than EEVV (SEQ ID NO.: 1) or VVVAAAEEE (SEQ ID NO.: 2)) form the exterior or surface of a peptide amphiphile containing structure.

In some embodiments, peptide sequences are selected based on criteria expected to result in a peptide amphiphile capable of self-assembly into a filament and electrospinning into a supramolecular fiber. In some embodiments, amino acids are selected that have strong hydrogen-bonding propensity. For example, valine (V) is a fairly hydrophobic residue. In some embodiments, a balance is achieved between hydrophobic and charged residues. In some embodiments, when valine is balanced with charged residues like glutamic acid (E) or lysine (K), the resulting peptide is useful within a peptide amphiphile. In some embodiments, the number of hydrogen bonding residues and charged residues should be approximately equal.

In some embodiments, random or arbitrary peptide sequences are tested for the characteristics useful or necessary for use in the presently claimed invention. For example, an amphiphile with an arbitrary peptide sequence is solubilized in water and analyzed to determine whether it is a good self-assembly and/or electrospinning candidate. Viscosity, solution conductivity, and surface tension are characteristics that are indicative of propensity to form the structures (e.g., filments, supramolecular fibers, etc.) described herein. For example, in some embodiments, a useful PA solution has a viscosity larger than 0.03 Pa-s between 10 and 100 Hz sheer rate (e.g., 0.04 Pa-s . . . 0.05 Pa-s . . . 0.1 Pa-s . . . 0.2 Pa-s . . . 0.5 Pa-s . . . 1.0 Pa-s . . . 2.0 Pa-s . . . 5.0 Pa-s, or more). In some embodiments, a PA solution has solution conductivity larger than 0.2 S/cm (e.g., 0.3 S/cm . . . 0.4 S/cm . . . 0.5 S/cm . . . 1.0 S/cm . . . 2.0 S/cm . . . 5.0 S/cm, or more). In some embodiments, the surface tension of a useful PA solution is lower than 60 mN/mm (e.g., 10 mN/mm . . . 20 mN/mm . . . 30 mN/mm . . . 40 mN/mm . . . 50 mN/mm).

Suitable peptide amphiphiles, PA nanofilaments, and associated reagents and methods are described, for example in U.S. patent application Ser. Nos. 8,512,693; 8,450,271; 8,138,140; 8,124,583; 8,114,835; 8,114,834; 8,080,262; 8,063,014; 7,851,445; 7,838,491; 7,745,708; 7,683,025; 7,554,021; 7,544,661; 7,534,761; 7,491,690; 7,452,679; 7,390,526; 7,371,719; 6,890,654; herein incorporated by reference in their entireties.

In some embodiments, PAs are placed in conditions (e.g., in aqueous solution (e.g., low concentration, high concentration, etc.) that promote PA self-assembly into nanofilaments. In some embodiments, self-assembly comprises the ordered formation of nanofilaments from individual PA units. In some embodiments, a nanofilament is formed from a single type of PA (e.g., same peptide segment and same hydrophobic segment). In some embodiments, a nanofilament comprises two or more different PAs (e.g., different peptide segment and/or different hydrophobic segment). In certain embodiments, hydrophobic segments pack the interior of the filament while peptide segments line the exterior, forming a nanofilament structure.

In some embodiments, self-assembly is carried out without heat treatment, surfactants, additional salts, etc. In some embodiments, PAs are dissolved in solvent (e.g., water) at low concentration (e.g., <10 wt %, <8 wt %, <6 wt %, <5 wt %, <4 wt %, <3 wt %, <2 wt %, <1 wt %, or less). In some embodiments, PAs are dissolved in solvent (e.g., water) at a concentration of: 0.01-10 wt %, 0.1-5 wt %, 0.1-4 wt %, 0.1-3 wt %, 0.1-2 wt %, 0.5-5 wt %, 0.5-4 wt %, 0.5-3 wt %, 0.5-2 wt %, etc. In some embodiments, after being dissolved, the PA solution is further diluted to lower the PA concentration (e.g., <5 wt %, <4 wt %, <3 wt %, <2 wt %, <1 wt %, 0.5 wt %, <0.1 wt %, or less). In some embodiments, PAs are diluted in solvent (e.g., water) to a concentration of: 0.01-10 wt %, 0.1-5 wt %, 0.1-4 wt %, 0.1-3 wt %, 0.1-2 wt %, 0.5-5 wt %, 0.5-4 wt %, 0.5-3 wt %, 0.5-2 wt %, etc. In certain embodiments, conditions of the PA solution are maintained to favor the formation of self-assembled PA nanofilaments.

In some embodiments, PAs self-assemble into functional nanofilaments with material properties (e.g., viscosity, solution conductivity, and surface tension) that are amenable for electrospinning.

In some embodiments, PA nanofilaments are subjected to electrospinning to produce supramolecular fibers. In some embodiments, PAs in solution are electrospun to form nanofilaments and fibers of nanofilaments. In some embodiments, PA nanofilaments are electrospun to form nanofilaments and fibers of nanofilaments. In some embodiments, the structures of nanofilaments and supramolecular fibers are held together by forces between PAs. In some embodiments the molecular structure of PA is maintained within nanofilaments and supramolecular fibers. In some embodiments, the structure of PA nanofilaments (e.g., cylindrical, ribbon, twisting ribbon, etc.) is maintained within a supramolecular fiber.

The process of electrospinning generally involves the creation of an electrical field at the surface of a liquid. The resulting electrical forces create a jet of liquid which carries electrical charge. Thus, the liquid jets maybe attracted to other electrically charged objects at a suitable electrical potential. As the jet of liquid elongates and travels, it will harden and dry. The produced fibers are collected on a suitably located, oppositely charged receiver and subsequently removed from it as needed, or directly applied to an oppositely charged generalized target area. The process provides variability in, among other characteristics, fiber diameter, fiber cross-sectional shape (e.g., flat, elliptical, circular, square, rectangular, concave, convex, etc.), thickness, composition, density, strength, etc.

In some embodiments, peptide amphiphiles are electrospun at low concentrations (e.g., <10 wt %, <8 wt %, <6 wt %, <5 wt %, <4 wt %, <3 wt %, <2 wt %, <1 wt %, <0.5 wt %, <0.2 wt %, <0.1 wt %, or less) in solvent (e.g., water, aqueous solution, etc.). In some embodiments, peptide amphiphiles are electrospun at concentrations of: 0.01-10 wt %, 0.1-5 wt %, 0.1-4 wt %, 0.1-3 wt %, 0.1-2 wt %, 0.5-5 wt %, 0.5-4 wt %, 0.5-3 wt %, 0.5-2 wt %, etc. In some embodiments, the PA solution comprises monomer peptide amphiphiles. In other embodiments, the PA solution comprises PA nanofilaments (e.g., self-assembled). In some embodiments, the PA solution comprises a single type of PA (e.g., homogeneous solution). In other embodiments, the PA solution comprises multiple (e.g., 2, 3, 4, 5, 6, or more) types of PA (e.g., heterogeneous solution). In some embodiments, the PA solution for electrospinning is pH adjusted (e.g., with additional NaOH or HCl) to provide suitable/optimal pH (e.g., for fiber formation, for filament formation, for PA solubility, etc.). In certain embodiments, other PA solution characteristics are optimized, including but not limited to: salt concentration, viscosity, temperature, volume, etc.

In certain embodiments, a PA solution is dispensed/extruded in the presence of a high electric field to perform electrospinning Any suitable device for electrospinning may find use in embodiments described herein. In some embodiments, the general approach of electrifying a needle that is extruding a PA solution is sufficient for electrospinning. There are numerous orientations for juxtaposing the emitter and collector. In some embodiments, forcespinning and/or near-field electrospinning find use. In some embodiments, a polarized needle (e.g., horizontal polarized needle) and collector find use. In some embodiments, a suitable device is one capable of producing a stable Taylor cone of the PA solution. In some embodiments, a suitable and/or optimal device has a needle-to-collector distance of 1-10 cm. In some embodiments, electrospinning is performed at 1-40 kV (e.g., 1 kV . . . 2 kV . . . 5 kV . . . 10 kV . . . 15 kV . . . 20 kV . . . 30 kV . . . 40 kV). In some embodiments, electrospinning is performed at a voltage to needle-to-collector distance of 0.1-5 kV/cm (e.g., 0.1 kV/cm . . . 0.2 kV/cm . . . 0.5 kV/cm . . . 1.0 kV/cm . . . 2.0 kV/cm . . . 3.0 kV/cm . . . 5.0 kV/cm). In some embodiments, electrospinning is performed at a flow rate of 0.05-5 mL/h (e.g., 0.05 mL/h . . . 0.1 mL/h . . . 0.2 mL/h . . . 0.3 mL/h . . . 0.4 mL/h . . . 0.5 mL/h . . . 0.6 mL/h . . . 1.0 mL/h . . . 2.0 mL/h . . . 5.0 mL/h). In some embodiments, electrospinning is performed at a temperature between 10° C. and 70° C. (e.g., 10° C. . . . 15° C. . . . 20° C. . . . 21° C. . . . 22° C. . . . 23° C. . . . 24° C. . . . 25° C. . . . 26° C. . . . 27° C. . . . 28° C. . . . 29° C. . . . 30° C. . . . 35° C. . . . 40° C. . . . 50° C. . . . 60° C. . . . 70° C.). In certain embodiments, electrospinning is performed without a carrier polymer or template. In some embodiments, electrospinning of PAs is done with the addition of an additional supramolecular polymer, covalent polymer, or additive. In some embodiments, PA electrospinning and other methods of manufacture are performed without heat treatment, additional surfactants, additional salts, etc.

In some embodiments, electrospinning is performed in conditions that allow for the formation of fibers of PA nanofilaments. In some embodiments, nanofilaments within supramolecular fibers retain their individual nanofiber structure. In some embodiments, a fiber comprises a single type of nanofilament comprising a single type of PA. In some embodiments, a fiber comprises a single type of nanofilament comprising a multiple types of PAs. In some embodiments, a fiber comprises multiple types of nanofilaments, each respectively comprising a single type of PA. In some embodiments, a fiber comprises multiple types of nanofilaments, each comprising one or more types of PAs. In some embodiments, a fiber comprises multiple types of nanofilaments, each comprising multiple types of PAs. In some embodiments in which multiple types of nanofilaments are combined in a supramolecular fiber, each of the individual filaments retains it filamentous structure (e.g., cylindrical, ribbon, twisting ribbon, etc.).

In some embodiments, individual nanofilaments retain their structure (e.g., cylindrical, ribbon, twisting ribbon, etc.) within a supramolecular fiber. In other embodiments, the individual nanofilaments retain individual characteristics (e.g., physically separate filaments), but have an altered shape or structure within the supramolecular fiber. For example, the periodicity of a twisted filament is altered, or a cylindrical filament adopts an elliptical cross-section. In some embodiments, the assemblies/structures of nanofilaments are only partially retained in the electrospun fiber.

In some embodiments, the electrospinning of peptide amphiphile nanofilaments into supramolecular fibers differs from previous techniques for assembling supramolecular assemblies of peptide amphiphiles and the resulting materials are readily distinguishable. For example, in some embodiment, methods described herein produce a dry material composed of microscopic (e.g., 0.2-10 μm diameter)

fibers (e.g., that can be coated on the surfaces of biomedical devices). Previous techniques (e.g., self-assembly pathway to aligned monodomain gels) results in macroscopic (e.g., 100-4-μm diameter) hydrated gel. Previous techniques utilize manual pipetting of a peptide amphiphile solution into a divalent ion solution to generate alignment, whereas in some embodiments, method herein utilize electrospinning of a PA solution (e.g., with nanofilaments formed therein) through air to facilitate the formation and dehydration of the fibers. In some embodiments, the high electric fields of electrospinning result in dehydration of the material and alignment of the peptide amphiphile nanofibers as a result of large shear forces produced in the Taylor cone during electrospinning. Previous methods merely rely on liquid crystal behavior of the nanofibers in solution. Both the methods and compositions produced are distinct.

In some embodiments, the electrospinning methods described herein result in materials that are significantly drier (e.g., less water) than the materials (e.g., peptide amphiphiles and/or nanofilaments) used to generate them. Moreover, materials produced by the methods described herein are significantly drier than fibers of PA nanofilaments produced by other methods (e.g., conventional methods (e.g., pipetting)). In some embodiments, electrospun fibers of PA nanofilaments comprise less than 20% (e.g., <20%, <15%, <10%, <9%, <8%, <7%, <6%, <5%, <4%, <3%, <2%, <1%, <0.5%, <0.2%, <0.1%, <0.05%, <0.02%, 0.01%, or less, or ranges therein) of the water of conventionally-produced fibers (e.g., those produced by pipetting). In some embodiments, comprise less than 10 wt % water (e.g., <15%, <10%, <9%, <8%, <7%, <6%, <5%, <4%, <3%, <2%, <1%, or less, or ranges therein).

In some embodiments, fibers described herein find use in a variety of applications. Various materials (e.g., mesh, film, coating, surface, etc.) are made from the PA fibers and find use in biomedical, research, clinical, veterinary, food preparation, and pharmaceutical applications. Materials derived from PA fibers may be used as stand-alone materials, as coatings or films on other items or devices, or in conjunction with other materials. There are numerous applications for such films and coatings. Coatings of electrospun PA material are placed on a myriad of medical devices including, but not limited to stents, pacemakers, bone plates, hip replacements, bandages, sutures, etc. A medical device that is used for a patient is often intended to support the local function of the body. For example, a bone plate is used to secure two halves of a damaged bone and provide mechanical rigidity; a pacemaker helps a heart beat at a regular pace. In these cases, damage to some part of the body was damaged/deteriorated/non-functioning and required a device to augment. A device coated with peptide amphiphiles would be able to present bioepitopes that can help regenerate local tissues and support local function. Therefore, in some embodiments, PA-coated pacemaker helps the heart beat and re-grow blood vessels locally; a PA-coated stent could keep a blood vessel open but also help re-grow the epithelium that was damaged, etc. A free-standing film of electrospun PA films is used for bandages or wrappings for outside the body, or as an implantable film to induce regeneration or prevent bioadhesions, etc. Compositions described herein are also used as a surface for cell culture.

Despite processing at high flow rate and high electric field, the individual nanoscale filaments are maintained within the electrospun fibers. Electrospun structures (See, e.g., FIG. 4*b*) exhibited distinct facets that were reminiscent of the structure of the original filament in solution. Other known electrospun systems produce continuous, space-filling fibers of a cylindrical or oblong quality (e.g., without maintaining the structures of component filaments), for example, due to the tight packing of the strands. Although embodiments are not limited to any particular mechanism of action and an understanding of the mechanism of action is not necessary to practice the embodiments described herein, the E2V3 PA assembles into twisted ribbons that are faceted and don't pack as well. Therefore, the resulting electrospun fibers of E2V3, particularly those that are thin, maintain this faceted quality.

Through electron and birefringence imaging, experiments conducted during development of embodiments described herein demonstrated that the electrospun fibers have filaments with very high degrees of alignment along their axial direction. In fact, the alignment was so precise that each individual fiber behaves like an optical polarizer. For example, two fibers that meet at 90 degree angle can extinguish transmitted light. This high degree of alignment was certainly unexpected based on previously characterized electrospun fibers and the chaotic nature of electrospinning.

Experiments were conducted during development of embodiments described herein to demonstrate that films composed of the electrospun PA fibers are bioactive. Electrospinning with other reagents (e.g., non-PA reagents) is chaotic, making it difficult to predict what while align on the surface of the fiber or a film derived therefrom. Using PA's, the epitopes are displayed on the surface; thereby ensuring that epitopes will be displayed prominently on the surface (e.g., to interact with cells and/or the surrounding tissue).

Experiments were conducted during development of embodiments described herein to demonstrate electrospinning of PA filaments onto indium tin oxide, a material conventionally used for solar cells. Cells were able to grow on the electrospun PA film coated surface.

EXPERIMENTAL

Peptide Amphiphiles. All resins and Fmoc-protected amino acids were purchased from Novabiochem Corporation. Solvents were purchased from Mallinckrodt (ACS reagent grade) and reagents were purchased from Aldrich and used as received. Solid-phase peptide synthesis was performed manually on a 0.5 mM scale using 50 mL peptide synthesis vessels (Chemglass) and a wrist-action shaker. A Wang resin with the first amino acid preloaded was used for all molecules. During synthesis, the Fmoc protecting group was removed by shaking the resin in 30% piperidine in N,N-dimethylformamide (DMF) for 10 min, rinsed, and repeated a second time. The resin was then washed with dichloromethane (DCM) and DMF and allowed to swell in DCM for 15 min before the coupling reaction. A total of 4 molar equiv of the Fmoc-protected amino acids were activated using 4 mol equiv of O-benzotriazole-N,N,N',N'-tetramethyluronium-hexafluorophosphate (HBTU) and dissolved in 30 mL of DMF. A total of 6 molar equiv of N,N-diisopropylethylamine (DIEA) were added to the amino acid solution, which was allowed to sit for 2 min before being added to the resin. The coupling reaction went for 3 h, at the end of which, the resin was washed in DCM and DMF, and ninhydrin tests were done to check for the presence of free amines. After a positive ninhydrin result, the coupling was repeated. The palmitoyl tail was added using the ratio of palmitic acid/HBTU/DIEA of 4:4:6. PAs were cleaved by shaking the resin in a solution of 95% trifluoroacetic acid (TFA), 2.5% triisopropyl silane (TIS), and 2.5% H2O for 3 h. The solution was drained into a round-bottom flask and the resin was rinsed several times with DCM to remove all unbound peptide. The DCM and TFA were removed using rotary evaporation, and the PA residue was washed with cold diethyl ether and poured into a fritted filter. After several diethyl ether washes, the flakes were allowed to dry and then placed in a vacuum desiccator until HPLC purification.

After cleavage, ultrapure water was added to make the PA solution 20 mM and ammonia hydroxide was added until the pH was raised to 8. The solution was passed through a 0.22 μM filter and injected into a preparative-scale reverse-phase HPLC running a mobile phase gradient of 98% H2O and 2% acetonitrile (spectroscopic grade, Mallinckrodt) to 100% acetonitrile. The 0.1% NH4OH was added to all mobile phases to aid PA solubility. The Phenomenex C18 Gemini NX column had a 5 μm particle size, a 110 Å pore size, and was 150×30 mm. HPLC fractions were checked for the correct compound using electrospray ionization mass spectroscopy (ESI-MS). Rotary evaporation was used to remove acetonitrile and solutions were lyophilized (Labconco, FreezeZone6) at a pressure of 0.015 Torr. To remove any excess salts, PAs were dissolved in water and dialyzed in 500 molecular weight cutoff dialysis tubing (Spectrum Laboratories). After dialysis, the PAs were lyophilized.

Solutions of Peptide Amphiphiles. Solutions of peptide amphiphiles for characterization and electrospinning were made by solubilizing the amphiphiles in ultrapure water (Millipore filtered, resistivity 18.2 MΩ·cm). PAs 1 and 2 were dissolved in ultrapure water, bath sonicated for 25 min, and allowed to rest at room temperature for 15 min prior to use. PA solutions with concentrations up to 3 wt % dissolved readily; no heat treatment, additional surfactants, or salts were used during the course of this study.

Figure 2:
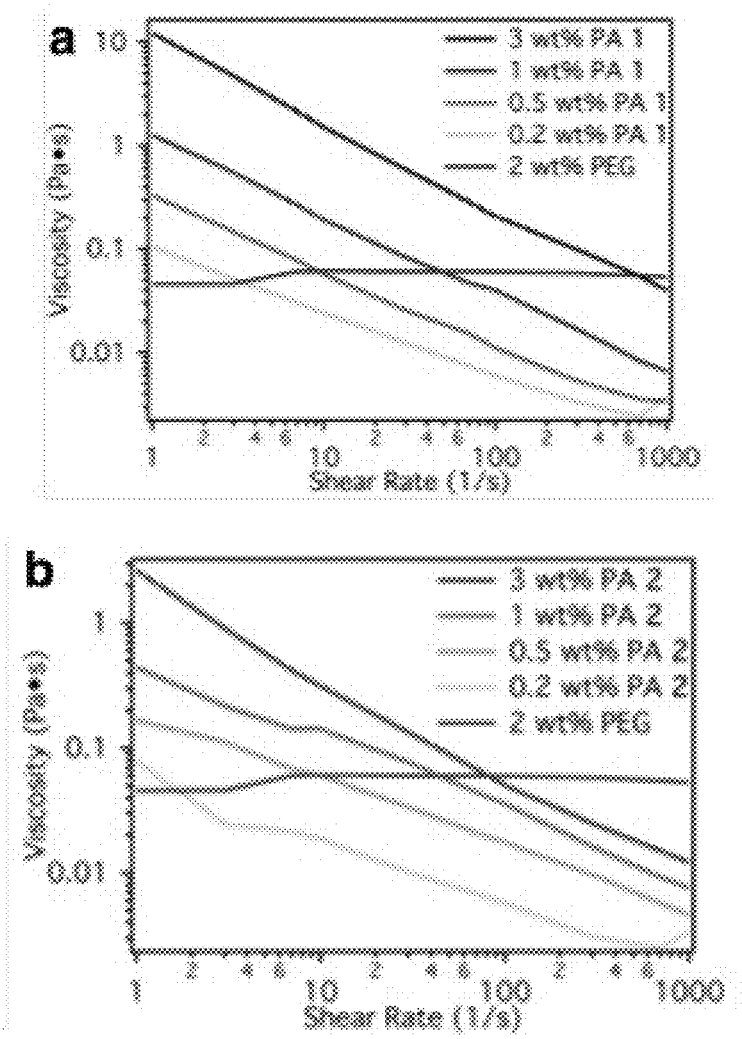
FIG. 2 shows shear rate and concentration dependent viscosity of (a) for PA 1 and (b) PA 2 compared to 2 wt % aqueous PEG.

Viscosity Measurements. Rheological properties of PA 1 and 2 were studied from 0.2 to 3 wt % (FIG. 2). The shear rate-dependent viscosity data was collected with a Paar Physica Modular Compact Rheometer 300 operating in a parallel-plate configuration with a 25 mm diameter and 0.5 mm gap distance at 25° C. The reported shear rate was the rate experienced by the fluid on the outer edge of the rotating plate.

Figure 3:
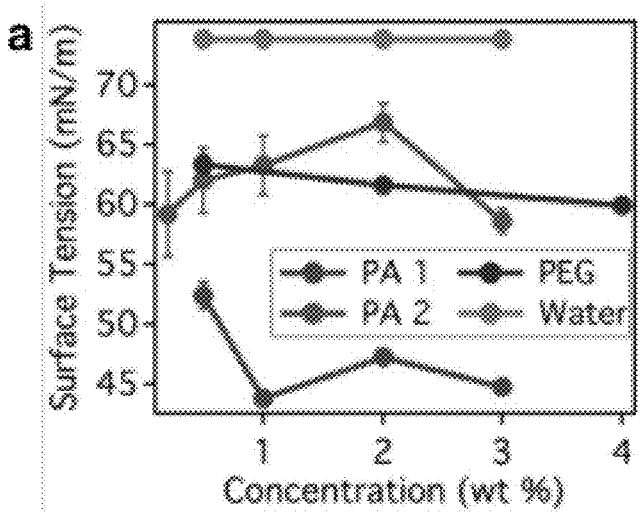
FIG. 3 shows (a) concentration dependent surface tension measurements of PA 1 and 2, and (b) concentration dependent solution conductivity measurements of PA 1 and PA 2.
Figure 3:
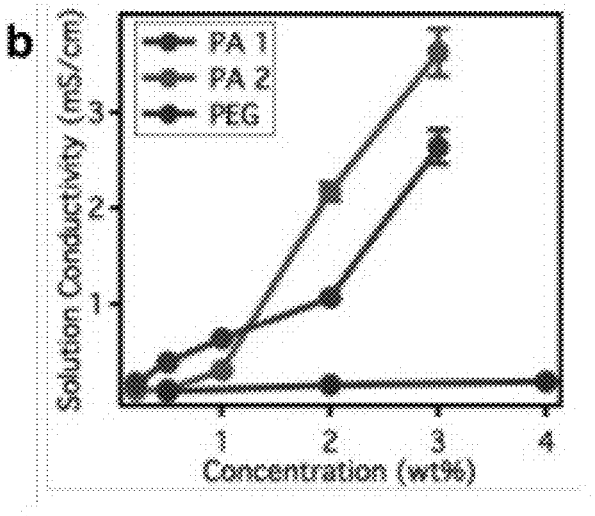

Measurements of Solution Conductivity. The solution conductivity was measured for PA 1 and 2 using a Malvern Zetasizer Nano (FIG. 3*b*). Approximately 300 μL of each solution was used.

Measurements of Surface Tension. The surface tension of PA 1 and PA 2 was measured with drop shape analysis using a KRÜSS DSA 100 instrument (FIG. 3*a*). A droplet was measured from a 5 mL syringe and quantified within 5 s of forming the droplet.

Electrospinning. Electrospinning was performed using a horizontal polarized needle and collector. The needle and collector were spaced 5 cm apart. The voltage applied was 10 kV. The flow rate for all experiments, unless otherwise noted, were 0.04 mL/h. A syringe pump was used to eject material from an electrified needle. Solutions of PA 1 and 2 were used with a 3 wt % concentration. Different substrates (e.g., stents, indium tin oxide, etc.) were taped with double-sided copper tape to the aluminum foil-based collector such that the electrospun fibers deposited on top.

Electron Microscopy. Scanning electron microscopy (SEM) was performed with a Hitachi 54800-II SEM. Electrospun samples were coated with 50 nm of osmium from an osmium tetroxide source using a Filgen Osmium Coater. This coating helped prevent charging of the sample inside the SEM.

Optical Imaging. Optical imaging was performed with a Nikon microscope in transmission mode. Polarizers were used to perform polarized optical microscopy.

Results

During experiments conducted during development of embodiments described herein, electrospinning was performed with PA molecules, for example, $C_{16}$-$E_2V_3$ (PA 1) and $C_{16}$—$V_3A_3E_3$ (PA 2) (See FIG. 1*a*). The latter has been shown to form highly viscous gels in solution and can be fashioned into aligned, monodomain arrays (Zhang et al. *Nat Mater* 9, 594 (2010); herein incorporated by reference in its entirety) when drawn through a solution containing divalent cations. The amino acid valine has a high propensity for β-sheet hydrogen bonding, (Pashuck & Stupp. *Journal of the American Chemical Society* 132, 6041 (2010); herein incorporated by reference in its entirety), which assists in self-assembly of nanofibers while charged glutamic acid residues impart solubility and biocompatibility. PAs 1 and 2 were dissolved in ultrapure water, bath sonicated for 25 minutes and allowed to rest at room temperature for 15 minutes prior to use. PA solutions (e.g., with concentrations up to 3 wt %) dissolved readily without heat treatment, additional surfactants, or salts. When diluted to low concentrations (e.g., <1%, <0.5%. <0.2%, <0.1%, <0.05%, or less) (w/v) in water), cryogenic transmission electron microscopy (cryoTEM) revealed that PA 1 formed twisted, ribbon-like nanostructures and PA 2 assembled into cylindrical nanofibers. PA 1 formed twisted ribbons in solution with a width of 30 nm and a periodicity of 300 nm. PA 2 formed long cylindrical nanofibres with lengths exceeding 10 μm and widths of 7 nm (See FIG. 1*b*, 1*c*). At higher concentrations used for electrospinning experiments (<3 wt %) thicker films formed which were not electron-transparent.

Electrospinning is enabled by achieving a balance of mechanical properties, surface tension, and charge density. To determine the appropriate (e.g., optimal) concentrations for electrospinning PAs, the viscosity, surface tension, and solution conductivity were measured. Rheological properties of PA 1 and 2 were studied at concentrations up to 3 wt % (See FIG. 2). The shear rate dependent viscosity data was collected with a Paar Physica Modular Compact Rheometer 300 operating in a 25 mm parallel-plate configuration with a 0.5 mm gap distance at 25° C. The reported shear rate was the rate experienced by the fluid on the outer edge of the rotating plate. For comparison, aqueous solutions of 2 wt % 400 kDa poly(ethylene glycol) (PEG), a polymer commonly used for electrospinning, were also measured. This concentration of PEG has been shown to have low viscosities but is still amenable for electrospinning (Fong et al. *Polymer* 40, 4585 (1999); herein incorporated by reference in its entirety). The mechanical properties of the PA solutions demonstrated concentration dependence. The viscosity, for example, increased by more than an order of magnitude from 0.2 wt % to 3 wt % (FIG. 2). At low shear rates, both PA 1 and PA 2 (3 wt %) had viscosities around 2 Pa·s. PA solutions proved to be more viscous than the PEG control at shear rates less than 100 Hz. In contrast, the PEG control had a viscosity that was nearly constant over the measurement range. In some embodiments, high viscosities are desired since high shear rates are applied to the solution at the tip of the electrospinning Taylor cone.

In some embodiments, a solution with a minimal surface tension is preferred for electrospinning to produce long, uniform fibres that are free of 'bead-on-string' morphologies (Li et al. *Adv Mater* 16, 1151 (2004); incorporated by reference in its entirety). To quantify this property, the surface tension of PA 1 and PA 2 were measured with drop shape analysis using a KRÜSS DSA 100 instrument (See FIG. 3*a*). The surface tension of PA 1 was found to be approximately 44.7 mN/m at 3 wt %. PA 2 had a higher surface tension of 58 mN/m at 3 wt %. Both molecules, however, had surface tensions comparable to or lower than the PEG solution or water alone. The surface tension of PA solutions varied with concentration; however, there was no clear trend between concentration and surface tension. The surface tension of water measured with the same technique was 73.8 mN/m at room temperature. The surface tension of PAs was lower than that of water at all PA concentrations. Furthermore, both PA-based solutions had surface tensions comparable to or lower than the PEG solution. The amphiphilic nature of the PA molecule in solution effectively decreased the surface tension making it practical for electrospinning.

Another parameter that influences fiber morphology in certain embodiments is the charge density. PA nanofibres exhibit high surface charge density due to the supramolecular assembly, which positions like charges at the surface of the nanostructure; this charge density affects droplet formation and solution conductivity. The solution conductivity was measured for PA 1 and 2 using a Malvern Zetasizer Nano (See FIG. 3*b*). Both supramolecular polymers had solution conductivities far exceeding that of the PEG. PA 1 and PA 2 had solution conductivities of 2.6 mS/cm and 3.6 mS/cm at 3 wt %, respectively. The large solution conductivity is attributed to the acidic residues on PA 1 and 2. Additionally, as the concentration increased so did the solution conductivity.

Experiments conducted during development of embodiments of described herein indicate that, in some embodiments, the materials produced by the methods described herein exhibit high viscosity, low surface tension, and high solution conductivity (e.g., making them good candidates for electrospinning).

Experiments demonstrated that solutions with a 3 wt % concentration were optimal for electrospinning. In some embodiments, solutions with lower concentrations had an unstable Taylor cone; this instability made it difficult to control the uniformity of the fibres. This was likely due to the low viscosity and limited entanglement between the assemblies in solution. Above 3 wt %, sodium hydroxide was added to increase the solubility of the peptide. In some embodiments, optimal parameters for electrospinning were 10 kV with a 5 cm needle-to-collector distance (2 kV/cm) with a 0.04 mL/h flow rate. This distance was sufficiently long for water to evaporate from the jet. Electrospun fibres of PA 1 and PA 2 had similar diameters of 3.8±0.4 μm and 3.9±1.3 μm, respectively. The electrospinning process was very sensitive to voltage: lower voltages did not produce a reliable Taylor cone and higher voltages resulted in electrospray.

Figure 4:
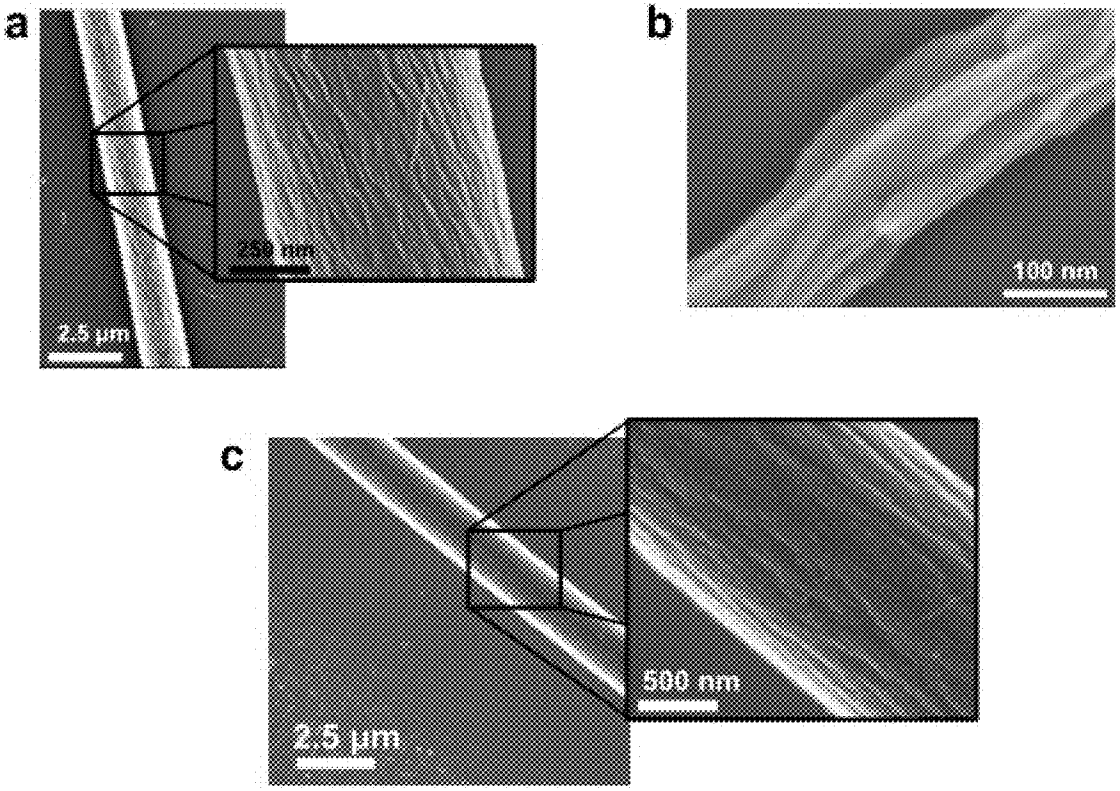
FIG. 4 shows SEM imaging of electrospun fibers from 2 wt % solutions of (a, b) PA 1 and (c) PA 2. Fibers are composed of highly aligned nanofilaments. (b) PA 1 forms assemblies of twisted nanoribbons that are maintained through the electrospinning process.
Figure 5:
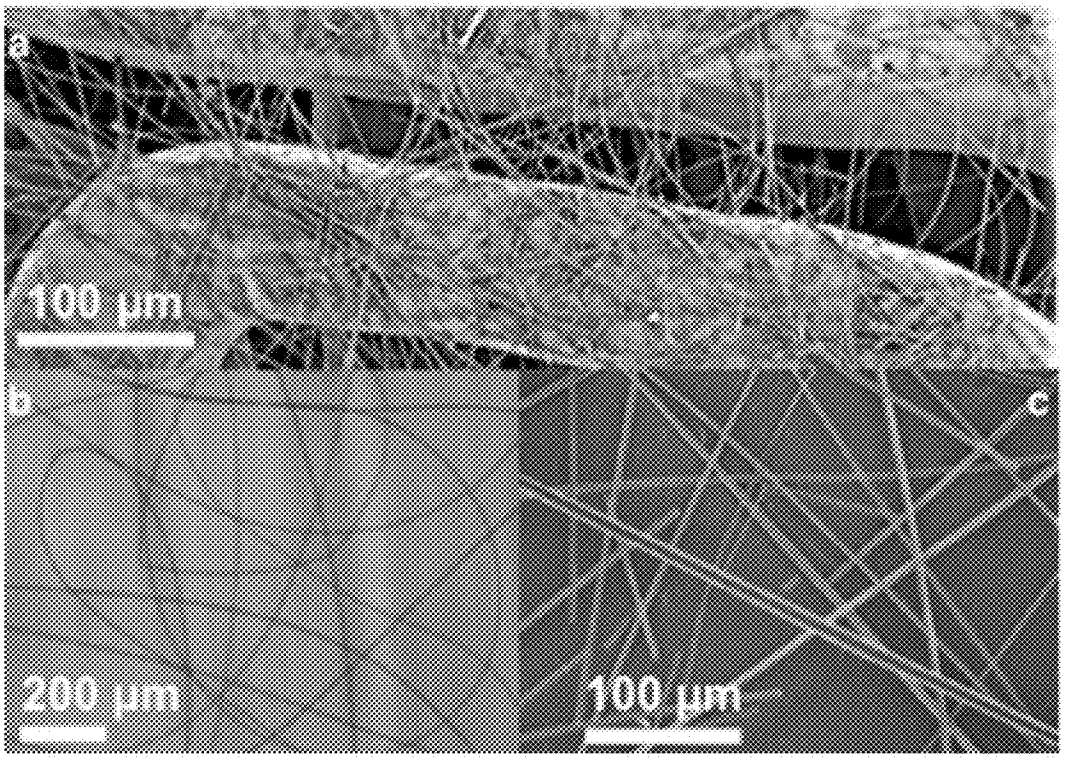
FIG. 5 shows electrospinning of PA fibers on (a) metallic coronary stent, (PA 1) (b) glass (PA 1) and (c) silicon (PA 2).

Electrospun fibres of PA 1 and 2 showed axial alignment of supramolecular polymers along the long axis of the fibre (See FIG. 4). Scanning electron microscopy (SEM) revealed that electrospun fibres of PA 1 were composed of individual nanostructures approximately 20 nm in width; these dimensions are consistent with dimensions observed in Cryo-TEM (See FIG. 1). Upon the electrospun fibers appeared non-uniform calcium phosphate from calcium-enriched media, which could provide a bioactive surface to promote bone mineralization.

Figure 6:
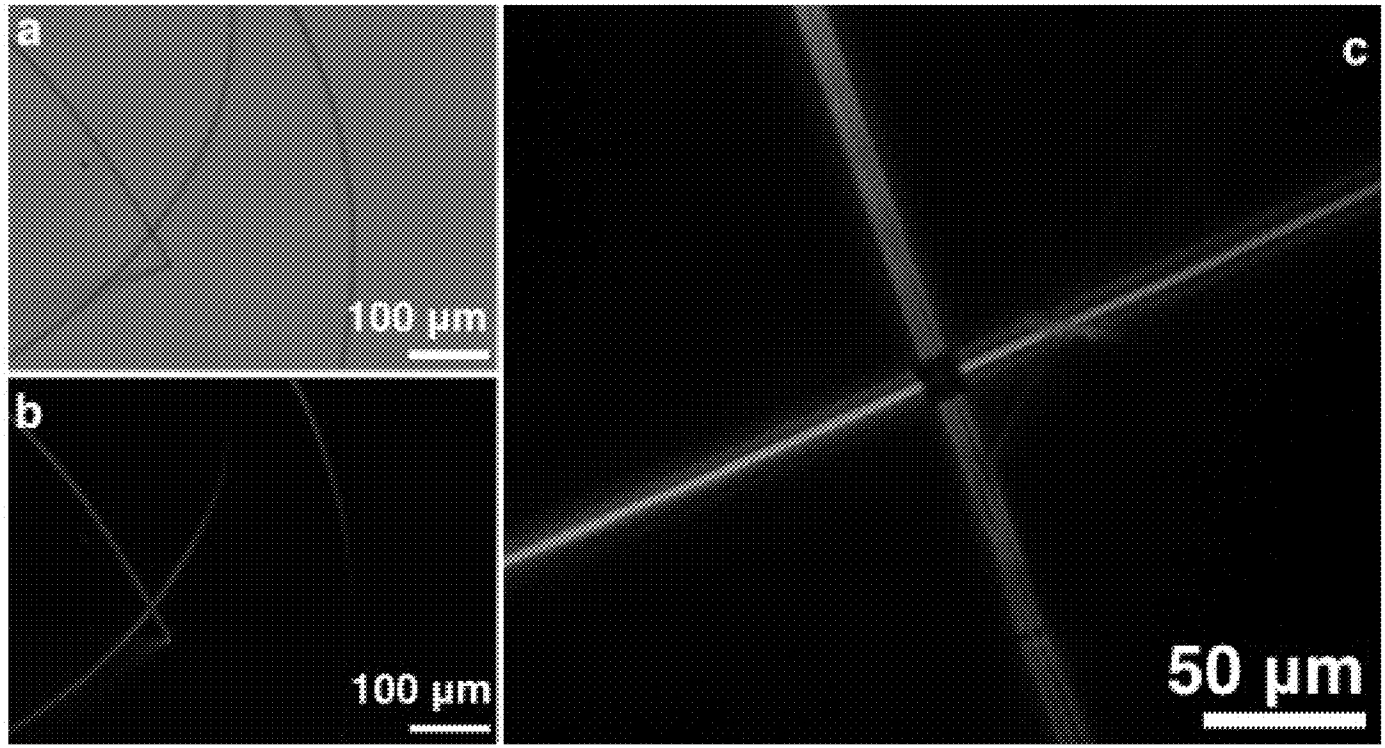
FIG. 6 shows optical imaging of electrospun PA fibers (a) without polarizers (PA 1), (b) with cross polarizers (PA 1), and (c) cross polarizers (PA 2). Birefringence with cross polarizers indicates that nanofilaments are highly aligned along the fiber.

The fibers produced by electrospinning PAs were examined by optical birefringence as well. PA solutions and aligned monodomains of PA gels show birefringence under crossed polarizers (FIG. 6). When two oriented fibers are laid orthogonally on top of each other, light is fully extinguished: this observation illustrates the high degree of alignment of nanostructures within the fiber. The large shear force at the Taylor cone aligns the supramolecular polymers along the spinning direction, resulting in electrospun fibers composed of highly aligned, densely packed nanostructures.

Furthermore, electrospun PA materials are a good candidate for applications in regenerative medicine. Preliminary studies demonstrated that cells are able to adhere to non-biological materials, such as indium tin oxide, when a coating of electrospun PA 1 is present. Additionally, PA 2 nucleated the growth of amorphous calcium phosphate from calcium-enriched media, which provides a bioactive surface to promote bone mineralization. These results indicate that the combination of peptide amphiphile self-assembly and electrospinning produces new types of functional coatings for biological applications.

REFERENCES (1) Li, D.; Wang, Y.; Xia, Y. Nano Lett. 2003, 3 (8), 1167-1171.

(2) Reneker, D. H.; Chun, I. Nanotechnology 1996, 7 (3), 216-223.

(3) Fong, H.; Chun, I.; Reneker, D. H. Polymer 1999, 40 (16), 4585-4592.

(4) Han, T.; Yarin, A. L.; Reneker, D. H. Polymer 2008, 49 (6), 1651-1658.

(5) Reneker, D. H.; Yarin, A. L. Polymer 2008, 49 (10), 2387-2425.

(6) Deitzel, J. M.; Kleinmeyer, J. D.; Hirvonen, J. K.; Tan, N. C. B. Polymer 2001, 42 (19), 8163-8170.

(7) Li, W. J.; Tuli, R.; Huang, X. X.; Laquerriere, P.; Tuan, R. S. Biomaterials 2005, 26 (25), 5158-5166.

(8) Li, W. J.; Tuli, R.; Okafor, C.; Derfoul, A.; Danielson, K. G.; Hall, D. J.; Tuan, R. S. Biomaterials 2005, 26 (6), 599-609.

(9) Matthews, J. A.; Wnek, G. E.; Simpson, D. G.; Bowlin, G. L. Biomacromolecules 2002, 3 (2), 232-238.

(10) Li, C. M.; Vepari, C.; Jin, H. J.; Kim, H. J.; Kaplan, D. L. Biomaterials 2006, 27 (16), 3115-3124.

(11) Cashion, M. P.; Li, X. L.; Geng, Y.; Hunley, M. T.; Long, T. E. Langmuir 2010, 26 (2), 678-683.

(12) McKee, M. G.; Layman, J. M.; Cashion, M. P.; Long, T. E. Science 2006, 311 (5759), 353-355.

(13) Singh, G.; Bittner, A. M.; Loscher, S.; Malinowski, N.; Kern, K. Adv. Mater. 2008, 20 (12), 2332-2336.

(14) Yan, X. Z.; Zhou, M.; Chen, J. Z.; Chi, X. D.; Dong, S. Y.; Zhang, M. M.; Ding, X.; Yu, Y. H.; Shao, S.; Huang, F. H. Chem. Commun. 2011, 47 (25), 7086-7088.

(15) Celebioglu, A.; Uyar, T. Langmuir 2011, 27 (10), 6218-6226.

(16) Grodowska, K.; Parczewski, A. Acta Pol. Pharm. 2010, 67 (1), 3-12.

(17) Cui, H.; Muraoka, T.; Cheetham, A. G.; Stupp, S. I. Nano Lett. 2009, 9 (3), 945-951.

(18) Hartgerink, J. D.; Beniash, E.; Stupp, S. I. Proc. Natl. Acad. Sci. U.S.A. 2002, 99 (8), 5133-5138.

(19) Hartgerink, J. D.; Beniash, E.; Stupp, S. I. Science 2001, 294 (5547), 1684-1688.

(20) Boekhoven, J.; Stupp, S. I. Adv. Mater. 2014.

(21) Tysseling, V. M.; Sahni, V.; Pashuck, E. T.; Birch, D.; Hebert, A.; Czeisler, C.; Stupp, S. I.; Kessler, J. A. J. Neurosci. Res. 2010, 88 (14), 3161-3170.

(22) Rajangam, K.; Behanna, H. A.; Hui, M. J.; Han, X.; Hulvat, J. F.; Lomasney, J. W.; Stupp, S. I. Nano Lett. 2006, 6 (9), 2086-2090.

(23) Huang, Z.; Newcomb, C. J.; Bringas, P., Jr; Stupp, S. I.; Snead, M. L. Biomaterials 2010, 31 (35), 9202-9211.

(24) Mata, A.; Geng, Y. B.; Henrikson, K. J.; Aparicio, C.; Stock, S. R.; Satcher, R. L.; Stupp, S. I. Biomaterials 2010, 31 (23), 6004-6012.

(25) Shah, R. N.; Shah, N. A.; Lim, M. M. D.; Hsieh, C.; Nuber, G.; Stupp, S. I. Proc. Natl. Acad. Sci. U.S.A. 2010, 107 (8), 3293-3298.

All publications and patents listed above and/or provided herein are incorporated by reference in their entireties. Various modifications and variations of the described compositions and methods of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention that are obvious to those skilled in the relevant fields are intended to be within the scope of the present invention.

SEQUENCE LISTING

```
<160> NUMBER OF SEQ ID NOS: 2

<210> SEQ ID NO 1
<211> LENGTH: 4
<212> TYPE: PRT
<213> ORGANISM: Artificial sequence
<220> FEATURE:
<223> OTHER INFORMATION: Synthetic

<400> SEQUENCE: 1

Glu Glu Val Val
1


<210> SEQ ID NO 2
<211> LENGTH: 9
<212> TYPE: PRT
<213> ORGANISM: Artificial sequence
<220> FEATURE:
<223> OTHER INFORMATION: Synthetic

<400> SEQUENCE: 2

Val Val Val Ala Ala Ala Glu Glu Glu
1               5
```

(26) Webber, M. J.; Tongers, J.; Newcomb, C. J.; Marquardt, K. T.; Bauersachs, J.; Losordo, D. W.; Stupp, S. I. Proc. Natl. Acad. Sci. U.S.A. 2011, 108 (33), 13438-13443.

(27) Stendahl, J. C.; Kaufman, D. B.; Stupp, S. I. Cell Transplant 2009, 18 (1), 1-12.

(28) Bond, C. W.; Angeloni, N.; Harrington, D.; Stupp, S.; Podlasek, C. A. J. Sex. Med. 2013, 10 (3), 730-737.

(29) Lee, S. S.; Huang, B. J.; Kaltz, S. R.; Sur, S.; Newcomb, C. J.; Stock, S. R.; Shah, R. N.; Stupp, S. I. Biomaterials 2013, 34 (2), 452-459.

(30) Li, D.; Xia, Y. N. Adv. Mater. 2004, 16 (14), 1151-1170.

(31) Theron, A.; Zussman, E.; Yarin, A. L. Nanotechnology 2001, 12 (3), 384-390.

(32) Zhang, S. M.; Greenfield, M. A.; Mata, A.; Palmer, L. C.; Bitton, R.; Mantei, J. R.; Aparicio, C.; de la Cruz, M. O.; Stupp, S. I. Nat. Mater. 2010, 9 (7), 594-601.

(33) Pashuck, E. T.; Cui, H. G.; Stupp, S. I. J. Am. Chem. Soc. 2010, 132 (17), 6041-6046.

(34) Koombhongse, S.; Liu, W. X.; Reneker, D. H. J. Polym. Sci., Polym. Phys. 2001, 39 (21), 2598-2606.

The invention claimed is:

1. A method of manufacturing fibers of peptide amphiphiles comprising:

(a) dissolving peptide amphiphiles in solvent under conditions such that the peptide amphiphiles form nanofilaments, wherein the peptide amphiphiles comprise a non-peptide lipophilic segment, a β-sheet-forming peptide segment, and a charged peptide segment; and (b) electrospinning the nanofilaments to produce fiber.

2. The method of claim 1, wherein the peptide amphiphiles are dissolved at, or diluted to, a concentration 0.1 to 5 wt %.

3. The method of claim 1, wherein electrospinning is performed at 5-20 kV.

4. The method of claim 1, wherein electrospinning is performed with a needle-to-collector distance of 1-40 cm.

5. The method of claim 1, wherein electrospinning is performed with a ratio of voltage to needle-to-collector distance of 0.5 to 4 kV/cm.

6. The method of claim 1, wherein electrospinning is performed at a flow rate of 0.01-0.2 mL/h.

* * * * *